US007239935B2

(12) United States Patent
Katagiri

(10) Patent No.: US 7,239,935 B2
(45) Date of Patent: Jul. 3, 2007

(54) PLUGGABLE EXTERNAL WIRELESS RECEIVER MODULE FOR A SEWING MACHINE

(75) Inventor: Kazushige Katagiri, Tainan Hsien (TW)

(73) Assignee: Taiwan Yamamoto Electric Industrial Co., Ltd., Tainan Hsien (TW)

( * ) Notice: Subject to any disclaimer, the term of this patent is extended or adjusted under 35 U.S.C. 154(b) by 201 days.

(21) Appl. No.: 11/020,918

(22) Filed: Dec. 22, 2004

(65) Prior Publication Data

US 2005/0139136 A1 Jun. 30, 2005

(30) Foreign Application Priority Data

Dec. 31, 2003 (TW) ..... 92223052 U

(51) Int. Cl.
*G06F 19/00* (2006.01)

(52) U.S. Cl. ..... 700/136; 112/275

(58) Field of Classification Search ..... 112/275, 112/277, 300; 318/16; 700/136, 137, 138
See application file for complete search history.

(56) References Cited

U.S. PATENT DOCUMENTS

| | | | | |
|---|---|---|---|---|
| 4,976,552 | A * | 12/1990 | Ishikawa et al. | 388/811 |
| 5,247,449 | A * | 9/1993 | Yoshida | 700/136 |
| 5,662,055 | A * | 9/1997 | Hartwig et al. | 112/102.5 |
| 6,979,963 | B2 * | 12/2005 | Katagiri | 318/16 |
| 2005/0115481 | A1 * | 6/2005 | Shad | 112/277 |

* cited by examiner

*Primary Examiner*—Danny Worrell
(74) *Attorney, Agent, or Firm*—Marshall & Melhorn, LLC

(57) ABSTRACT

A pluggable external wireless receiver module includes a housing, a power terminal unit, a receiver device, and a control terminal unit. The power terminal unit is mounted on the housing and is adapted for connection to a power source. The receiver device is mounted in the housing, and includes a receiver unit for receiving a wireless control signal, a processing unit for processing the control signal received by the receiver unit, and a driving unit controlled by the processing unit for generating a motor control output corresponding to the processed control signal. The control terminal unit is mounted on the housing, is connected to the driving unit of the receiver device, and is adapted for connection to a connector of a sewing machine, thereby transmitting the motor control output from the driving unit to the sewing machine for controlling operation of a motor of the sewing machine accordingly.

6 Claims, 3 Drawing Sheets

PLUGGABLE EXTERNAL WIRELESS RECEIVER MODULE FOR A SEWING MACHINE

CROSS-REFERENCE TO RELATED APPLICATION

This application claims priority of Taiwanese application no. 092223052, filed on Dec. 31, 2003.

BACKGROUND OF THE INVENTION

1. Field of the Invention

The invention relates to a wireless receiver module, more particularly to a pluggable external wireless receiver module for a sewing machine.

2. Description of the Related Art

Control of an internal motor of a conventional sewing machine is usually conducted through a pedal-type controller. In particular, the rotation speed of an internal motor of the sewing machine is varied according to treading action on a pedal of the controller.

Referring to FIG. 1, a conventional sewing machine is shown to include a machine body 91 having a motor (not shown) disposed therein, a socket connector 92 mounted on and accessible externally of the machine body 91, a plug connector 93 for mating with the socket connector 92, a power cord 94 and a signal cord 95 each connected at one end to the plug connector 93, and a controller 96 connected to the other end of the signal cord 95.

In operation, the controller 96 converts user treading action into corresponding control signals that are transmitted through the signal cord 95 and the socket connector 92 into the machine body 91 for controlling operation of the motor inside the machine body 91.

When the conventional sewing machine is in use, the machine body 91 is usually placed on top of a table, whereas the controller 96 is placed on the ground to permit treading on the same. Therefore, since signal transmission between the controller 96 and the machine body 91 is conducted in a wired manner, the signal cord 95 must extend from the top of the table to the ground, which can result in some inconvenience.

To overcome the aforesaid drawback, it has been proposed heretofore to use a wireless mode of transmission between the controller and the machine body. To this end, a transmitter and a receiver are respectively provided in the controller and the machine body such that the controller converts user treading action into wireless control signals for subsequent transmission by the transmitter to the receiver in the machine body, thereby permitting control of the operation of the motor in the machine body.

It is noted that the space in the machine body of a conventional sewing machine is fully utilized. Hence, installation of the receiver inside the machine body is not allowed unless the original design of the machine body is modified. In other words, it is not possible to upgrade older sewing machines for wireless transmission purposes in view of lack of sufficient space in the machine body for accommodating the receiver.

SUMMARY OF THE INVENTION

Therefore, the object of the present invention is to provide a pluggable external wireless receiver module for a sewing machine so as to overcome the aforesaid drawbacks associated with the prior art.

According to this invention, there is provided a pluggable external wireless receiver module for a sewing machine that includes a machine body, a motor disposed in the machine body, and a connector mounted on and accessible externally of the machine body. The pluggable external wireless receiver module comprises a housing, a power terminal unit, a receiver device, and a control terminal unit.

The power terminal unit is mounted on the housing, and is adapted for connection to a power source. The receiver device is mounted in the housing, and includes a receiver unit adapted for receiving a wireless control signal, a processing unit connected to the receiver unit for processing the control signal received by the receiver unit, and a driving unit connected to the processing unit and the power terminal unit. The driving unit is controlled by the processing unit in accordance with the control signal received by the receiver unit so as to generate a corresponding motor control output. The control terminal unit is mounted on the housing, is connected to the driving unit of the receiver device, and is adapted for connection to the connector of the sewing machine, thereby transmitting the motor control output from the driving unit to the sewing machine for controlling operation of the motor of the sewing machine accordingly.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
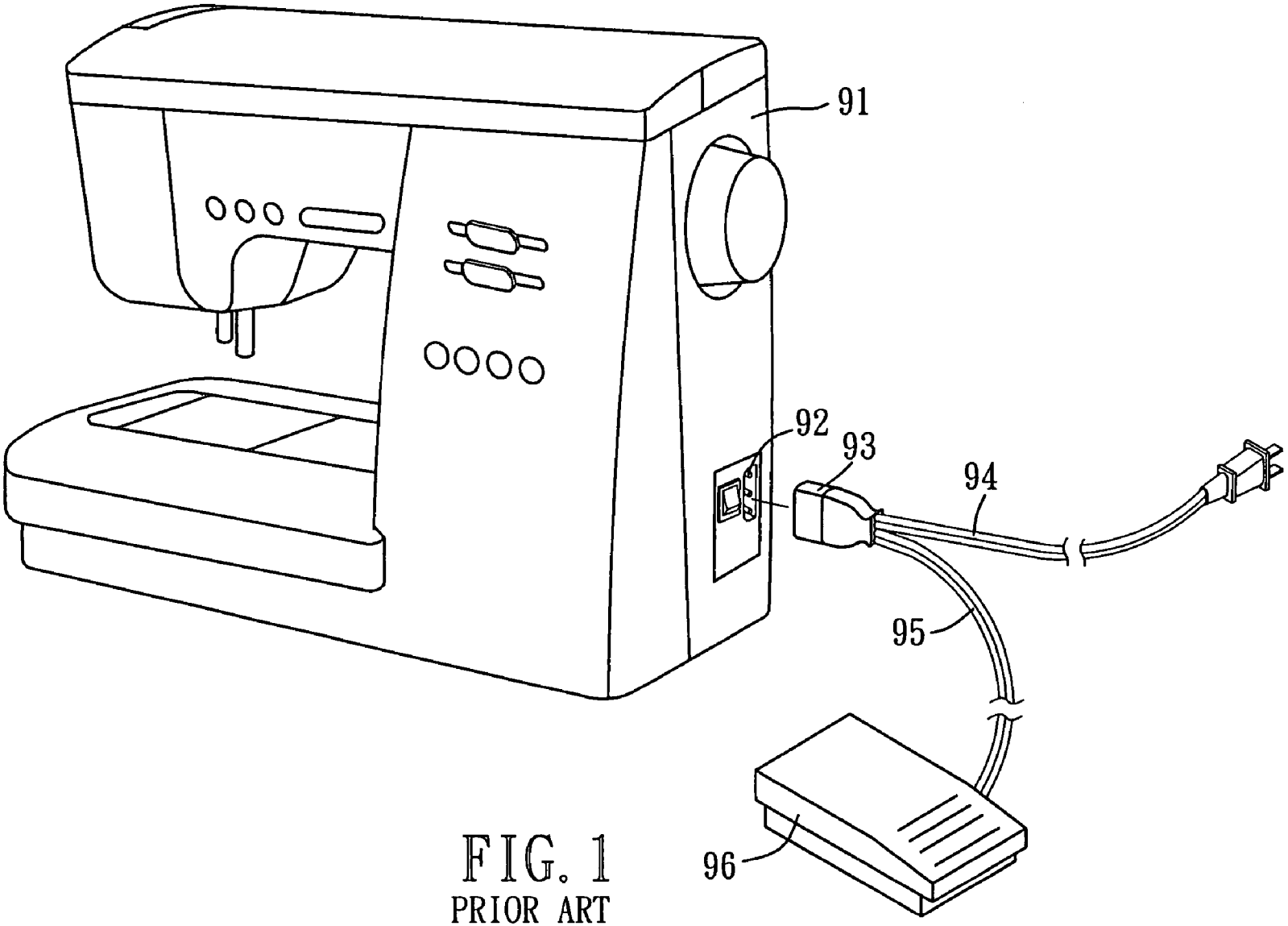
FIG. 1 PRIOR ART
FIG. 1 illustrates a conventional sewing machine.
Figure 2:
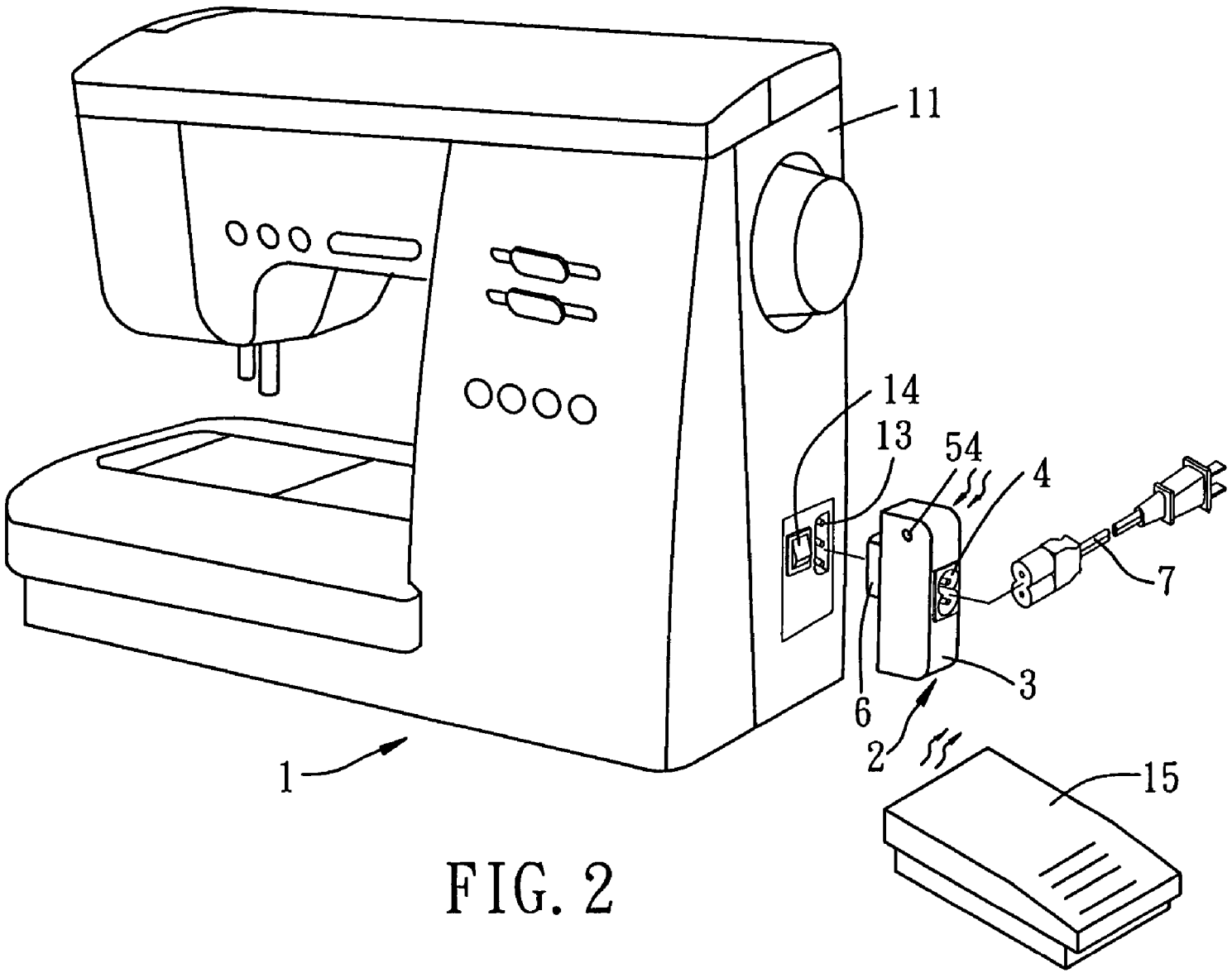
FIG. 2 is an exploded perspective view to illustrate a sewing machine and the preferred embodiment of a pluggable external wireless receiver module according to the present invention.
Figure 3:
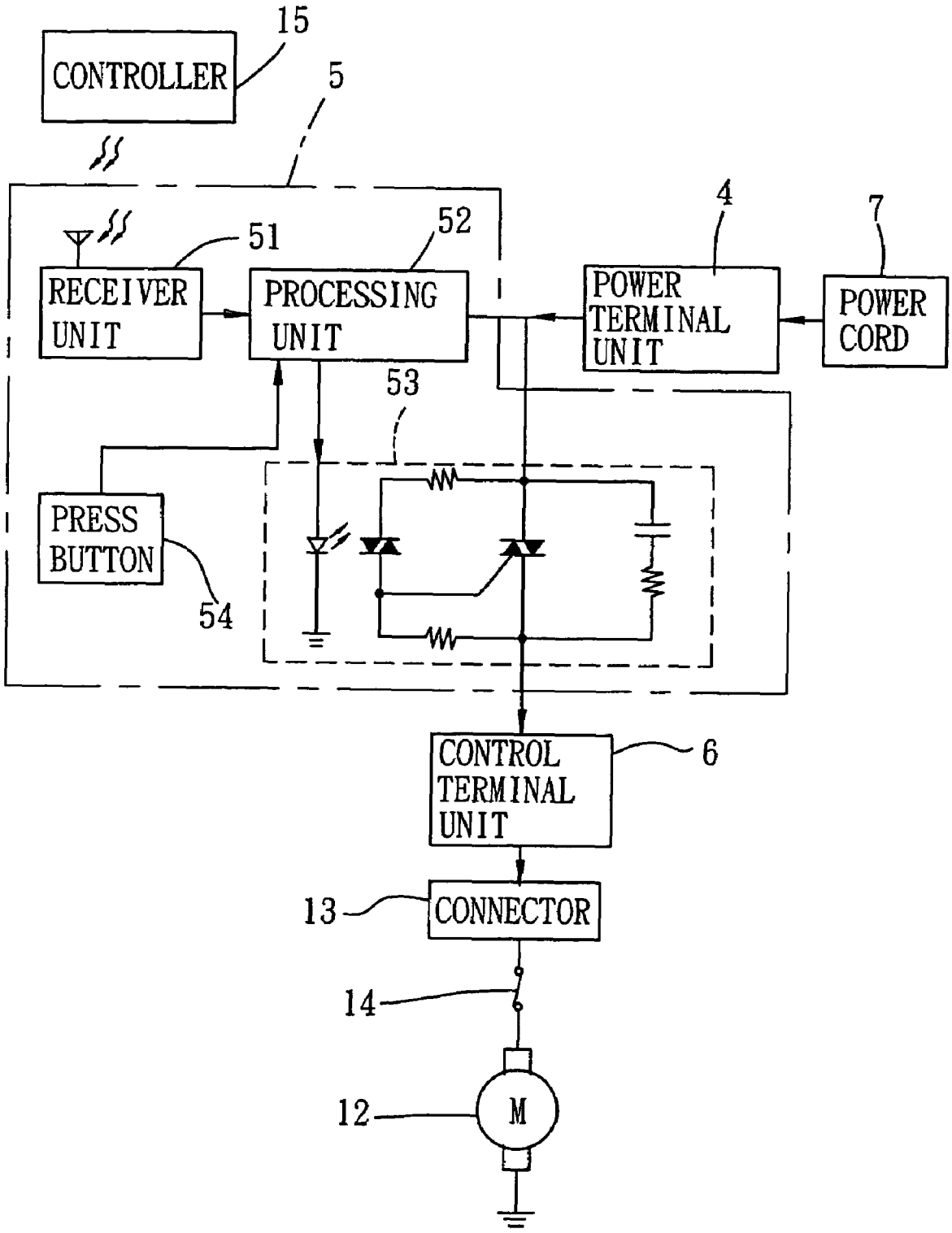
FIG. 3 is a schematic circuit block diagram to illustrate components of the preferred embodiment.

Referring to FIGS. 2 and 3, the preferred embodiment of a pluggable external wireless receiver module 2 of this invention is shown to be adapted for use with a sewing machine 1 that includes a machine body 11, a motor 12 (see FIG. 3) disposed in the machine body 11, a connector 13 mounted on and accessible externally of the machine body 11, a switch 14 for making and breaking electrical connection between the motor 12 and the connector 13, and a controller 15 that includes a transmitter circuit and that is capable of generating wireless control signals in response to user treading action in a conventional manner.

The pluggable external wireless receiver module 2 includes a rectangular housing 3, a power terminal unit 4, a receiver device 5, a control terminal unit 6, and a power cord 7.

The power cord 7 is adapted for connection to a power source, such as a commercial AC power source.

The power terminal unit 4 is mounted on a rear side of the housing 3, and is adapted for connection to the power source through the power cord 7.

The receiver device 5 is mounted in the housing 3, and includes a receiver unit 51, a processing unit 52, a driving unit 53, and a press button 54.

The receiver unit 51 is adapted for receiving the wireless control signal transmitted from the controller 15. The processing unit 52 is connected to the receiver unit 51 for processing the control signal received by the receiver unit 51. The driving unit 53 is connected to the processing unit 52 and the power terminal unit 4. The driving unit 53 is controlled by the processing unit 52 in accordance with the control signal received by the receiver unit 51 so as to generate a corresponding motor control output. The press button 54 is provided on the housing 3, is coupled to the processing unit 52, and is manually operable for setting up the processing unit 52. Since the feature of this invention does not reside in the setup process of the processing unit 52, a detailed description of the same is dispensed with herein for the sake of brevity.

The control terminal unit 6 is mounted on a front side of the housing 3, is connected to the driving unit 53 of the receiver device 5, and is adapted for connection to the connector 13 of the sewing machine 1. Therefore, the motor control output from the driving unit 53 can be transmitted to the sewing machine 1 for controlling operation of the motor 12 of the sewing machine 1 accordingly.

In use, it is only required to connect the control terminal unit 6 of the pluggable external wireless receiver module 2 to the connector 13 of the sewing machine 1 for enabling wireless control of the motor 12 through the controller 15. Because the wireless receiver module 2 is not required to be disposed in the machine body 11, older sewing machines can be easily upgraded for use with the wireless receiver module 2 of this invention.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A pluggable external wireless receiver module for a sewing machine, the sewing machine including a machine body, a motor disposed in the machine body, and a connector mounted on and accessible externally of the machine body, said pluggable external wireless receiver module comprising:

a housing;

a power terminal unit mounted on said housing and adapted for connection to a power source;

a receiver device mounted in said housing and including a receiver unit adapted for receiving a wireless control signal, a processing unit connected to said receiver unit for processing the control signal received by said receiver unit, and a driving unit connected to said processing unit and said power terminal unit, said driving unit being controlled by said processing unit in accordance with the control signal received by said receiver unit so as to generate a corresponding motor control output; and a control terminal unit mounted on said housing, connected to said driving unit of said receiver device, and adapted for connection to the connector of the sewing machine, thereby transmitting the motor control output from said driving unit to the sewing machine for controlling operation of the motor of the sewing machine accordingly.

2. The pluggable external wireless receiver module as claimed in claim 1, further comprising a power cord for connecting said power terminal unit to the power source.

3. The pluggable external wireless receiver module as claimed in claim 1, wherein said power terminal unit and said control terminal unit are disposed respectively on opposite sides of said housing.

4. The pluggable external wireless receiver module as claimed in claim 1, wherein said receiver device further includes a press button provided on said housing, coupled to said processing unit, and manually operable for setting up said processing unit.

5. A pluggable wireless module, comprising:

a control terminal unit in a direct physical and electrical pluggable connection with a connector of a sewing machine and in sole electrical power communications with a motor of said sewing machine, thus said pluggable wireless module is external to said sewing machine; and a driving unit utilizing wireless user treading signals from a user treading action controller to generate corresponding motor control output signals to said sewing machine motor by way of said pluggable control terminal unit.

6. The pluggable wireless module as claimed in claim 5, further comprising:

a receiver unit;

a processing unit; and a driving unit;

wherein said receiver unit receives said wireless user treading signals from said user treading action controller, said receiver unit communicates corresponding control signals to said processing unit, said processing unit controls said driving unit, said driving unit generates corresponding motor control output signals, and said motor control output signals are utilized for controlling said sewing machine motor.

* * * * *